US006739236B2

(12) United States Patent
Kato et al.

(10) Patent No.: US 6,739,236 B2
(45) Date of Patent: May 25, 2004

(54) PISTON FOR FLUID MACHINE AND METHOD OF MANUFACTURING THE SAME

(75) Inventors: Takayuki Kato, Kariya (JP); Naoya Yokomachi, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 49 days.

(21) Appl. No.: 10/266,525

(22) Filed: Oct. 8, 2002

(65) Prior Publication Data

US 2003/0066419 A1 Apr. 10, 2003

(30) Foreign Application Priority Data

Oct. 10, 2001 (JP) ..... P2001-312760

(51) Int. Cl.[7] ..... F01B 3/00
(52) U.S. Cl. ..... 92/71; 92/248
(58) Field of Search ..... 92/71, 248, 222

(56) References Cited

U.S. PATENT DOCUMENTS 5,960,542 A 10/1999 Umemura et al. ..... 29/888.042
6,339,984 B1 1/2002 Sugioka et al. ..... 92/248
6,453,554 B1 * 9/2002 Fukushima et al. ..... 92/71

* cited by examiner

*Primary Examiner*—Edward K. Look
*Assistant Examiner*—Michael Leslie
(74) *Attorney, Agent, or Firm*—Morgan & Finnegan, LLP

(57) ABSTRACT

A piston is used for a fluid machine. The fluid machine has a cylinder bore and a piston driving unit for driving the piston in a housing. The piston has a piston body made of resin, a coupler made of metal and a resin unit. The piston body is accommodated in the cylinder bore. The coupler is connected to the piston body. The coupler is operatively connected to the piston driving unit. The resin unit is connected to the coupler for preventing the coupler from contacting a contacting portion on the side of the housing. The piston body and the resin unit are made of the same resin.

15 Claims, 6 Drawing Sheets

PISTON FOR FLUID MACHINE AND METHOD OF MANUFACTURING THE SAME

BACKGROUND OF THE INVENTION

The present invention relates in general to a piston for a fluid machine that includes a piston body made of resin and a coupler made of metal, and more particularly to a method for manufacturing the piston used in the fluid machine.

As a typical piston for the fluid machine, Japanese Unexamined Patent Publication No. 9-256952 is known. In the publication, a rotation restricting portion is formed on the piston in order to restrict the rotation of the piston around the axis of the piston that is accommodated in a cylinder bore of a compressor.

The rotation restricting portion is formed on a coupler (or a neck portion of the piston) that operatively connects the piston to a mechanism for driving the piston. The rotation of the piston is restricted by the contact of the rotation restricting portion against a housing of the compressor. The restriction of the rotation substantially prevents the coupler from contacting the piston driving mechanism. Thereby, vibration and noise to be generated due to the contact are prevented. In general, a coating is applied to the surface of the rotation restricting portion in order to reduce the sliding resistance between the rotation restricting portion and the housing.

As a typical piston for a fluid machine where a coating is applied, Japanese Unexamined Patent Publication No. 2000-274366 is known. In the publication, a piston body that is accommodated in a cylinder bore is made of resin in order to reduce the weight of the piston and reduce the sliding resistance between the piston body and the cylinder bore.

In the constitution, the piston body is fixed to the coupler that operatively connects the piston to a mechanism for driving the piston by an insert molding.

In the constitution according to Japanese Unexamined Patent Publication No. 2000-274366, however, reduction of a sliding resistance between a rotation restricting portion and the housing is not considered. In order to provide a means for reducing the sliding resistance between the rotation restricting portion and the housing, it is required to provide the means in a process other than the process for fixing the piston body to the coupler. That is, since a process for coating the piston body is omitted by employing the piston body made of resin, in a sense a cost is lowered. However, since the rotation restricting portion is formed in another process, it is actually hard to lower the cost by reducing the number of processes for manufacturing the piston. In addition, in this case, even if resin is employed as the means for reducing the sliding resistance, material of the resin is not considered. Therefore, even in an aspect of handling the material, the cost is not lowered.

SUMMARY OF THE INVENTION

The present invention is directed to a piston for a fluid machine, which lowers cost and a sliding resistance between the piston and a housing, and to a method for manufacturing the piston.

According to the present invention, a piston is used for a fluid machine. The fluid machine has a cylinder bore and a piston driving unit for driving the piston in a housing. The piston has a piston body made of resin, a coupler made of metal and a resin unit. The piston body is accommodated in the cylinder bore. The coupler is connected to the piston body. The coupler is operatively connected to the piston driving unit. The resin unit is connected to the coupler for preventing the coupler from contacting a contacting portion on the side of the housing. The piston body and the resin unit are made of the same resin.

Furthermore, the present invention has a following feature. A piston is used for a fluid machine. The fluid machine has a cylinder bore and a piston driving unit for driving the piston in a housing. The piston has a piston body made of resin, a coupler made of metal and a resin unit. The piston body is accommodated in the cylinder bore. The coupler is connected to the piston body while operatively connected to the piston driving unit. The resin unit is connected to the coupler for preventing the coupler from contacting a contacting portion of the housing. A method of manufacturing the piston includes the following step. The step is forming the resin unit and the piston body simultaneously in a process of forming the coupler by an insert molding.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

A piston for a fluid machine according to a first preferred embodiment of the present invention will now be described with reference to FIGS. 1 through 4.

Figure 1:
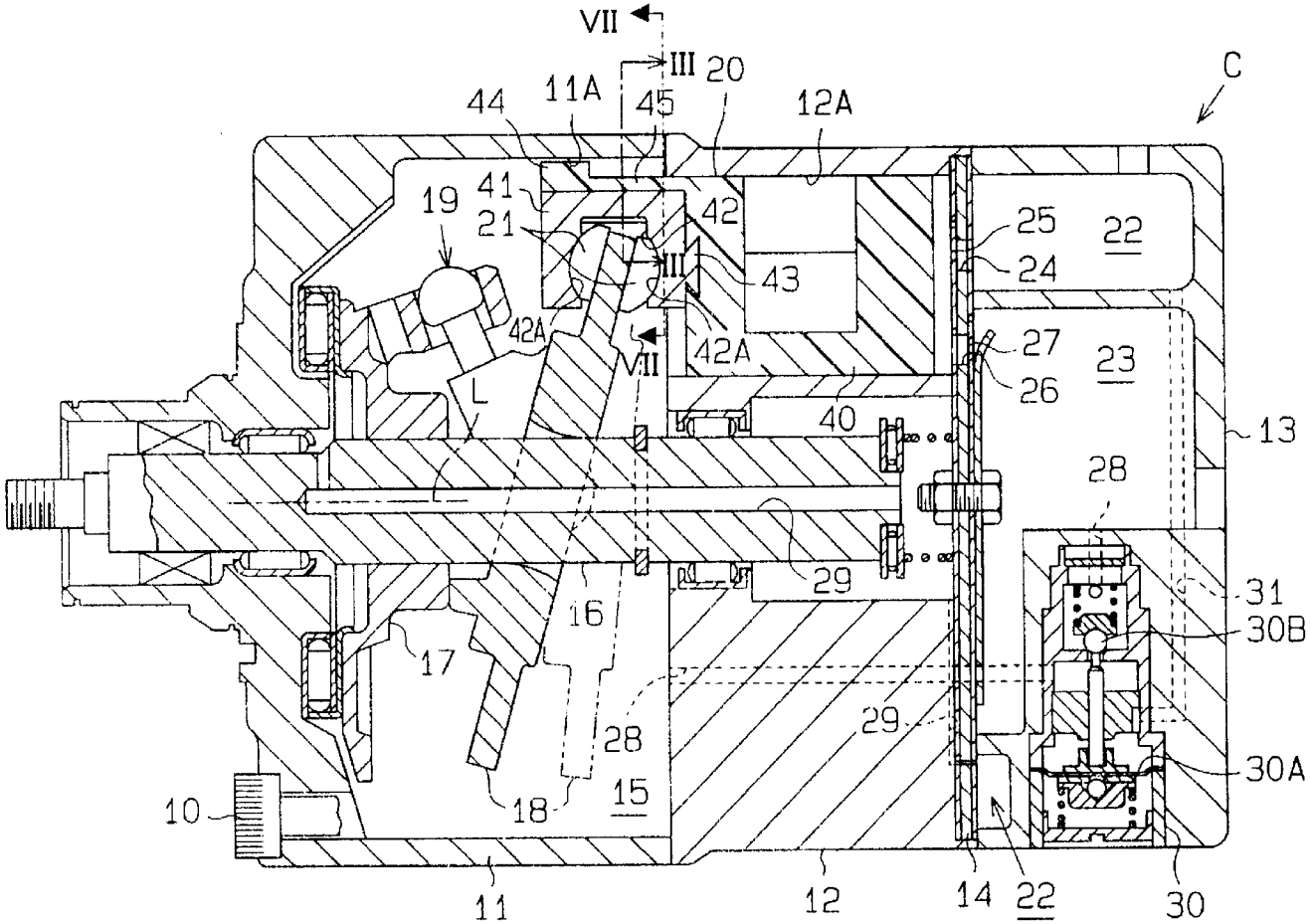
FIG. 1 is a cross-sectional view illustrating a compressor according to a first preferred embodiment of the present invention.

FIG. 1 shows a single-headed piston type variable displacement compressor C (hereinafter a compressor) that is a fluid machine for use in a vehicle air conditioner. In FIG. 1, the left side of the compressor C is front and the right side of the compressor C is rear.

As shown in FIG. 1, a housing of the compressor C or a compressor housing is constituted of a front housing 11, a cylinder block 12 and a rear housing 13. The rear end of the front housing 11 is secured to the front end of the cylinder block 12, which is a center housing. The front end of the rear housing 13 is secured to the rear end of the cylinder block 12 through a valve plate assembly 14. A plurality of bolts 10 (only one bolt is illustrated in FIG. 1) is screwed into the rear housing 13 while extending through the front housing 11, the cylinder block 12 and the valve plate assembly 14. Thereby, the compressor housing and the valve plate assembly 14 are secured to each other.

Still referring to FIG. 1, the front housing 11 and the cylinder block 12 define a crank chamber 15. The drive shaft 16 extends through the crank chamber 15 and is rotatably supported in the front housing 11 and the cylinder block 12. The drive shaft 16 is operatively connected to a vehicle engine that is an external drive source through a clutch mechanism such as a magnetic clutch, although the vehicle engine and the magnetic clutch are not illustrated in the drawings.

The lug plate 17 is secured to the drive shaft 16 in the crank chamber 15. A swash plate 18 that is a cam plate is connected to the drive shaft 16 through a hinge mechanism 19. The swash plate 18 is integrally rotated with the drive shaft 16 and is inclinable with respect to an axis L of the drive shaft 16.

A plurality of cylinder bores 12A (only one cylinder bore is illustrated in FIG. 1) is formed through the cylinder block 12 around the axis L of the drive shaft 16. A plurality of single-headed pistons 20 for use in a fluid machine is each accommodated in the cylinder bores 12A. Each of the pistons 20 is engaged with the swash plate 18 through a pair of shoes 21. Therefore, the rotary motion of the drive shaft 16 is converted into the reciprocating motion of each piston 20 in the corresponding cylinder bore 12A through the swash plate 18 and the shoes 21.

A suction chamber 22 and a discharge chamber 23 are defined between the rear housing 13 and the valve plate assembly 14. A suction port 24, a suction valve 25, discharge port 26 and a discharge valve 27 constitute the valve plate assembly 14. Refrigerant gas in the suction chamber 22 is drawn into the corresponding cylinder bore 12A by the motion of the corresponding piston 20 in the direction from the right side to the left side through the associated suction port 24 pushing away the associated suction valve 25. The refrigerant gas drawn into the cylinder bore 12A is compressed to a predetermined pressure by the motion of the corresponding piston 20 in the direction from the left side to the right side and is discharged to the corresponding discharge chamber 23 through the associated discharge port 26 pushing away the associated discharge valve 27.

A supply passage 28 connects with the discharge chamber 23 and the crank chamber 15. A bleed passage 29 connects with the crank chamber 15 and the suction chamber 22. A displacement control valve 30 is placed in the supply passage 28. A pressure sensing passage 31 connects with the suction chamber 22 and the displacement control valve 30.

A diaphragm 30A of the displacement control valve 30 responds to pressure in the suction chamber 22 that is introduced through the pressure sensing passage 31 such that the displacement control valve 30 opens and closes a valve body 30B. Thereby, the displacement control valve 30 varies the opening degree of the supply passage 28. When the opening degree of the supply passage 28 varies, the amount of refrigerant gas in the discharge chamber 23 that is supplied into the crank chamber 15 is varied. On the other hand, the refrigerant gas in the crank chamber 15 is bled into the suction chamber 22 through the bleed passage 29. The pressure in the crank chamber 15 is varied in accordance with the amount of refrigerant gas that is supplied into and bled out of the crank chamber 15. Therefore, pressure differential between the crank chamber 15 and the cylinder bore 12A that is applied to the piston 20 is varied. As a result, a stroke amount of the piston 20 and the inclination angle of the swash plate 18 are varied. Accordingly, displacement is adjusted.

In the present embodiment, the drive shaft 16, the lug plate 17, the swash plate 18, the hinge mechanism 19 and the shoes 21 constitute a piston driving unit.

Next, the constitution of the piston 20 will be described in detail.

Figure 2:
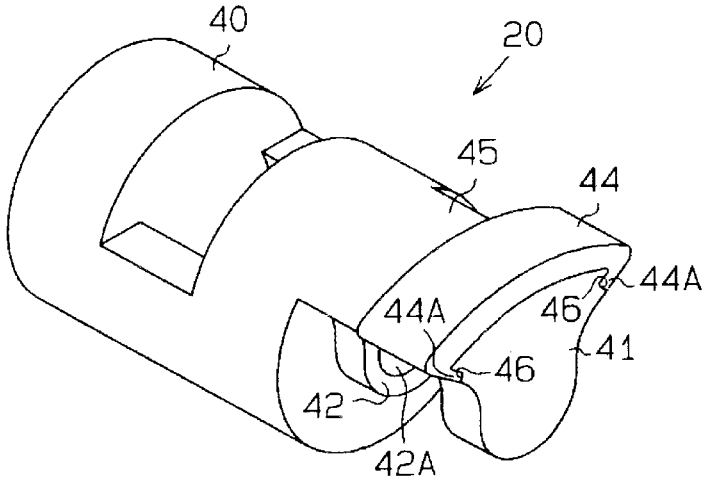
FIG. 2 is a perspective view of a piston for the compressor according to the first preferred embodiment of the present invention.

As shown in FIGS. 1 and 2, the piston 20 has a piston body 40 made of resin and a coupler 41 made of metal. The piston body 40 is accommodated in the cylinder bore 12A. The coupler 41 is connected to the periphery of the swash plate 18 through the corresponding shoes 21. The piston body 40 and the coupler 41 are connected to each other in the direction of an axis of the piston 20.

The piston body 40 is made of fluoro resin having a solid lubricating performance. The coupler 41 is manufactured by forging and casting an aluminum alloy. The aluminum alloy is employed for constituting the coupler 41 in order to reduce the weight of the piston 20.

A shoe inserted portion 42 is formed in the coupler 41. A pair of spherical concaves 42A is formed at the front side and the rear side of the axis of the piston 20 so as to face to each other in the shoe inserted portion 42. The pair of shoes 21, which are substantially in the shape of hemisphere, sandwich the front surface and the rear surface of the periphery of the swash plate 18 while received respectively by the corresponding spherical concaves 42A in the shoe inserted portion 42 so as to freely slide. Thus, the slide of the shoes 21 on the front and rear surfaces of the swash plate 18 enables the piston 20 to reciprocate in the direction of the axis of the piston 20 based on the rotary motion of the swash plate 18, which is integrally rotated with the drive shaft 16.

Referring to FIG. 1, an inserted portion 43 is integrally formed with the coupler 41. The inserted portion 43 is substantially in the shape of a truncated cone. The inserted portion 43 is formed such that the diameter of the proximal end is smaller than that of the distal end.

The piston body 40 is adhered to the coupler 41 so as to involve the inserted portion 43 in the coupler 41. The weight of the piston body 40 is reduced by forming a cavity in the middle of the piston body 40.

The constitution that the piston 20 is connected to the swash plate 18 through the shoes 21 allows the piston 20 to rotate around the axis of the piston 20 or the axis of the piston body 40. In the present embodiment, the piston 20 has a rotation restricting potion 44 for restricting the rotation of the piston 20 around the axis of the piston 20 due to the contact with an inner circumferential surface 11A of the front housing 11. The rotation restricting portion 44 is formed such that one of the ends in the direction of the circumference of the piston body 40 contacts the inner circumferential surface 11A of the front housing 11 when the piston 20 is about to rotate around the axis of the piston 20. The inner circumferential surface 11A functions as a contacting portion of the compressor housing.

The rotation restricting portion 44 is integrally formed with the piston body 40 through a connecting portion 45 while adhered to the coupler 41. In other words, the rotation restricting portion 44, the connecting portion 45 and the piston body 40 are made of the same resin. In addition, the rotation restricting portion 44 and the connecting portion 45 constitute a resin unit for preventing the coupler 41 from contacting the inner circumferential surface 11A. The rotation restricting portion 44 is formed such that resin covers the surface of the coupler 41 at the opposite side to the drive shaft 16 at the front end of the coupler 41 (or at the opposite side to the piston body 40). Thereby, the coupler 41 does not directly contact the inner circumferential surface 11A of the front housing 11 by the rotation of the piston 20.

As shown in FIG. 2, a pair of separation preventing pieces 44A for holding a part of the coupler 41 is integrally formed with the rotation restricting portion 44 in order to prevent the resin unit from separating from the coupler 41. The separation preventing pieces 44A, which are formed on the rotation restricting portion 44, each function as a protrusion for engaging with an engaging portion 46 formed on the coupler 41.

Figure 3:
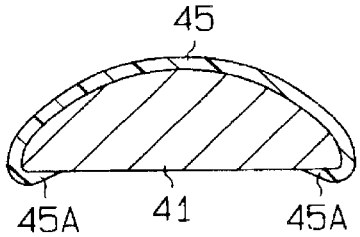
FIG. 3 is a partially enlarged cross-sectional view illustrating a coupler, a connecting portion and a pair of separation preventing pieces of the piston according to the first preferred embodiment of the present invention.

In a similar manner, as shown in FIG. 3, a pair of separation preventing pieces 45A for holding a part of the coupler 41 is integrally formed with the connecting portion 45 in order to prevent the resin unit from separating from the coupler 41. FIG. 3 is a cross-sectional view illustrating the coupler 41 and the connecting portion 45 in the perpendicular plane to the axis of the piston 20 in the middle of the shoe inserted portion 42 in the direction of the axis of the piston 20. In other words, FIG. 3 shows a partial cross-sectional view taken along the line III—III in FIG. 1.

Figure 4:
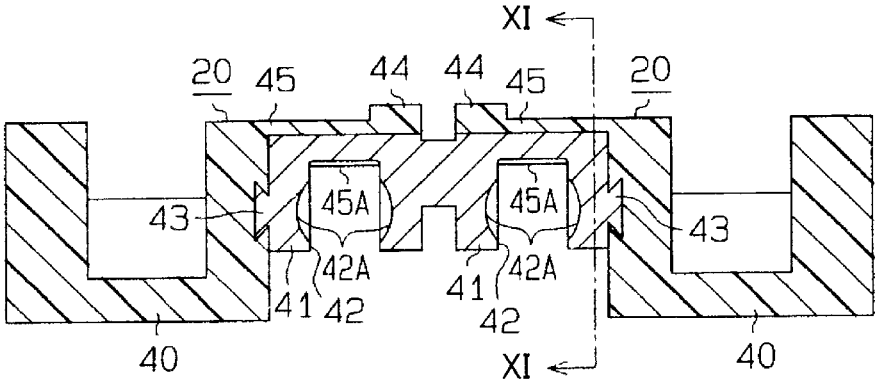
FIG. 4 is a cross sectional view illustrating a pair of pistons where a pair of couplers is connected to each other.

FIG. 4 shows the piston body 40, the rotation restricting portion 44 and the connecting portion 45 that are formed by an insert molding of the coupler 41. In the process of the insert molding, two couplers 41 that are integrally connected with each other are inserted respectively into the resin piston bodies 40 at both ends of the connected couplers 41. At the same time, the rotation restricting portion 44 and the connecting portion 45 are integrally formed with the piston body 40. That is, in the present embodiment, the piston body 40, the rotation restricting portion 44 and the connecting portion 45 are formed at the same time in the process of the insert molding. FIG. 4 shows the two couplers 41 that are integrally formed with each other, which have not been separated from each other yet. In this state, the two couplers 41 are separated from each other by cutting. Thereby, two individual pistons 20 are formed. The coupler 41 is formed by forging and casting and then the spherical concaves 42A of the shoe inserted portion 42 are machined. However, after the insert molding, the spherical concaves 42A may be machined when the outer circumferential surface of the piston body 40 are machined. In this case, the cutting is finally performed.

In the first preferred embodiment, the following advantageous effects are obtained.

(1) The rotation restricting portion 44 is formed on the piston 20 for restricting the rotation of the piston 20 due to the contact with the inner circumferential surface 11A of the front housing 11. Therefore, the rotation of the piston 20 is restricted, thereby preventing the coupler 41 from interfering with the swash plate 18 near the shoe inserted portion 42. As a result, the vibration and noise do not occur due to the above interference.

(2) The contact between the coupler 41 and the inner circumferential surface 11A due to the rotation of the piston 20 around the axis of the piston body 40 is prevented by the rotation restricting portion 44 that constitutes the resin unit. The rotation restricting portion 44 is made of resin. Therefore, for example, as compared with the rotation restricting portion 44 made of metal, the rotation restricting portion 44 made of resin restrains the noise generated due to the contact with the inner circumferential surface 11A. Furthermore, the rotation restricting portion 44 is made of fluoro resin having a solid lubricating performance. Therefore, the friction generated due to the slide between the rotation restricting portion 44 and the inner circumferential surface 11A is relatively small.

(3) The resin unit (or the rotation restricting portion 44 and the connecting portion 45) and the piston body 40 are made of the same resin. At this time, the resin unit can be formed on the coupler 41 in the same process (in the process of the insert molding in the present embodiment) as the process that the piston body 40 is formed on the coupler 41. For example, as compared with the case that the resin unit is formed on the coupler 41 in the different process from the process that the piston body 40 is formed on the coupler 41, the case that the piston body 40 and the resin unit are formed simultaneously in the process enables the number of processes for manufacturing the piston 20 to reduce. Therefore, a manufacturing cost can be lowered.

(4) The resin unit (or the rotation restricting portion 44 and the connecting portion 45) and the piston body 40 are integrally formed with each other. As compared with the constitution that the resin unit and the piston body 40 are individually formed, the constitution that the resin unit and the piston body 40 are integrally formed with each other ensures a relatively large fixing strength of the resin unit to the coupler 41. Also, when the piston body 40 and the resin unit are formed on the coupler 41 by the insert molding, a gate of the die for the insert molding of the piston body 40 and a gate of the die for the insert molding of the resin unit can be for common use.

(5) The resin unit (or the rotation restricting portion 44 and the connecting portion 45) holds a part of the coupler 41 in order to prevent the resin unit from separating from the coupler 41. Thereby, the resin unit can be prevented from being separated from the coupler 41.

(6) The engaging portion 46 formed on the coupler 41 and the protrusion formed on the resin unit (or on the rotation restricting portion 44) are engaged with each other. The engagement of the protrusion and the recess can prevent the resin unit from separating from the coupler 41.

(7) The compressor C is constituted so as to reciprocate the piston body 40 along the cylinder bore 12A in accordance with the rotary motion of the swash plate 18 operatively connected to the piston body 40 through the coupler 41 and the shoes 21. In the constitution, the piston 20 is rotated around the axis of the piston body 40 by the rotary motion of the swash plate 18, that is, for example, the shoes 21 are accompanied by the swash plate 18 due to slide between the swash plate 18 and the shoes 21. The rotation restricting portion 44 prevents the coupler 41 from contacting the inner circumferential surface 11A due to the rotation of the piston 20 around the axis of the piston body 40.

(8) The coupler 41 is made of aluminum (herein aluminum alloy). Therefore, as compared with a coupler made of iron, the weight of the coupler 41 made of aluminum is easily reduced.

A piston for a fluid machine according to a second preferred embodiment of the present invention will now be described with reference to FIGS. 5 through 7. In the present embodiment, the constitution of the piston according to the first preferred embodiment is mainly changed. The other constitution of the second preferred embodiment is substantially the same as that of the first preferred embodiment. Therefore, the same reference numerals of the first preferred embodiment are applied to those of the second preferred embodiment and overlapped explanations are omitted.

Figure 5:
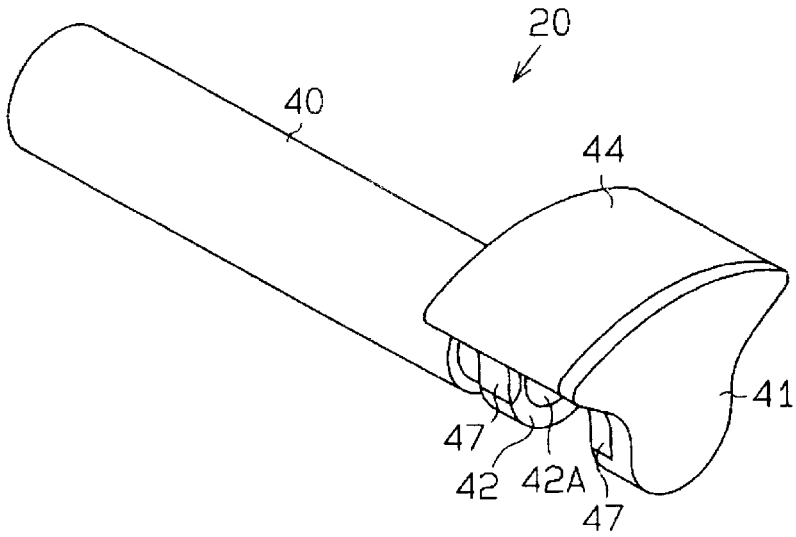
FIG. 5 is a perspective view of a piston for a compressor according to a second preferred embodiment of the present invention.

FIG. 5 shows a perspective view illustrating a schematic of the piston 20 according to the second preferred embodiment. The piston 20 according to the second preferred embodiment is used in a compressor that requires compressing relatively high-pressure refrigerant such as a carbon dioxide.

Figure 6:
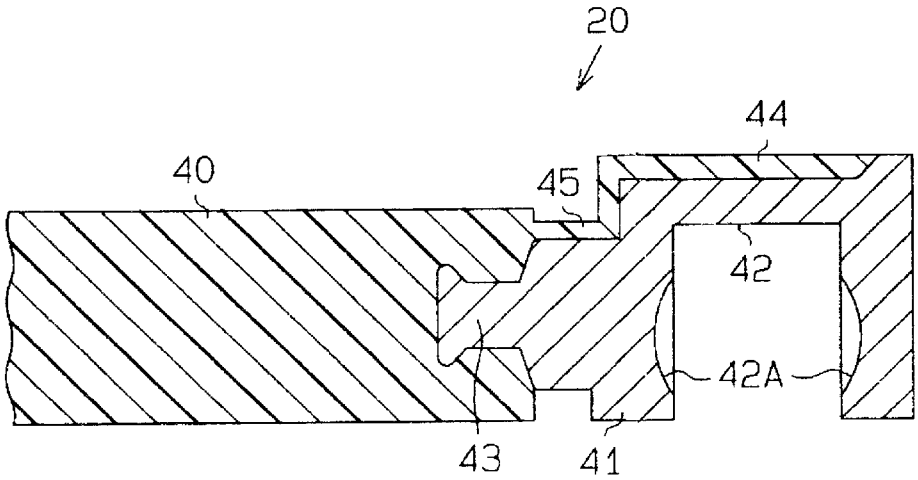
FIG. 6 is a partial cross-sectional view of the piston according to the second preferred embodiment of the present invention.

As shown in FIGS. 5 and 6, the piston 20 of the second preferred embodiment has a higher ratio of the axial length to the radial length than that of the first preferred embodiment. That is, the piston 20 of the second preferred embodiment is longer and thinner than that of the first preferred embodiment. The piston body 40 is formed in a cylindrical shape. The weight of the piston body 40 has not been reduced by forming a cavity in the piston body 40.

In the present embodiment, the rotation restricting portion 44 is formed so as to cover substantially the whole surface of the coupler 41 at the opposite side to the drive shaft 16. The rotation restricting portion 44 is integrally formed with the piston body 40 through the connecting portion 45. That is, the rotation restricting portion 44 and the connecting portion 45 are made of the same resin as the piston body 40. In the present embodiment, the piston body 40, the rotation restricting portion 44 and the connecting portion 45 are formed also simultaneously in the process of the insert molding of the coupler 41.

Figure 7:
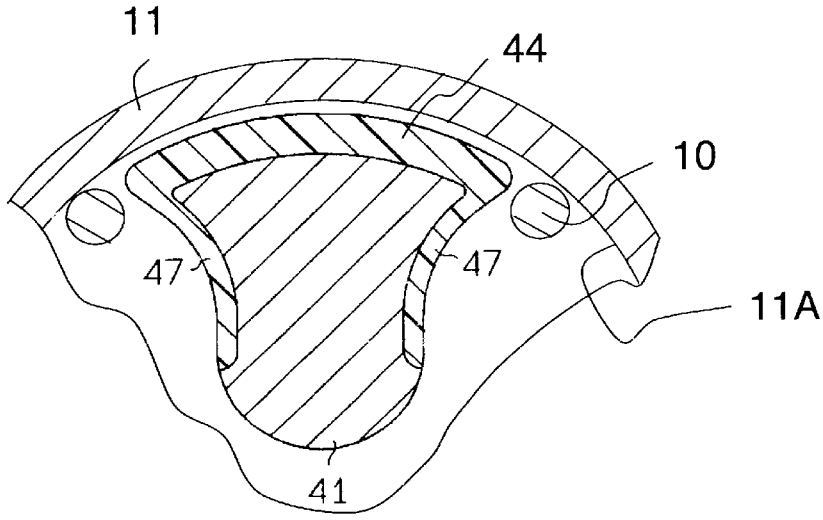
FIG. 7 is a partially enlarged cross-sectional view illustrating a coupler, a rotation restricting portion and a pair of extending portions of the piston, a front housing and bolts that are taken along the line VII—VII in FIG. 1.

As shown in FIGS. 5 and 7, a pair of extending portions 47 is formed at the right and left sides of the rotation restricting portion 44 shown in FIG. 7 so as to hold the coupler 41 with the rotation restricting portion 44. The rotation restricting portion 44, the connecting portion 45 and the extending portions 47 constitute a resin unit, thereby preventing the coupler 41 from contacting the inner circumferential surface 11A.

The rotation restricting portion 44 and the extending portions 47 are formed so as not to cover a part of the front end of the coupler 41. The surface of the coupler 41 that is not covered with the rotation restricting portion 44 and the extending portions 47 (except the surface facing toward) is formed so as to extend frontward from the surfaces of the rotation restricting portion 44 and the extending portions 47. In the present embodiment, a protrusion is formed near the inner circumferential surface 11A so as to be capable of only contacting the rotation restricting portion 44 when the piston 20 is rotated around the axis of the piston body 40. Thereby, a part of the coupler 41 that is not covered with the rotation restricting portion 44 and the extending portions 47 does not contact the compressor housing.

In the second preferred embodiment, the above-described effects (1) through (5), (7) and (8) of the first preferred embodiment are substantially obtained.

In the present invention, the following alternative embodiments are also practiced.

In the above-described embodiments, the resin that constitutes the piston body 40 and the resin unit is fluoro resin. The resin is, however, not limited to the fluoro resin. For example, phenolic resin may be used.

In the above-described embodiments, the contact portion at the side of the compressor housing may be a part of the compressor housing other than the inner circumferential surface 11A. For example, the contact portion may be the bolt 10. In this case, the contact between the bolt 10 and the rotation restricting portion 44 restricts the rotation of the piston 20 around the axis of the piston body 40.

The piston body and the resin unit do not require forming on the coupler in the same process. For example, in the case that the piston body and the resin unit are formed on the coupler in the different process from each other, if both the piston body and the resin unit are constituted by the same resin, as compared with the piston body and the resin unit constituted by the different resin from each other, handling of the material for constituting both of the piston body and the resin unit is relatively simple. Thereby, a handling cost is lowered.

In the first preferred embodiment, the engaging portion 46 formed on the coupler 41 is engaged with the separation preventing pieces 44A formed on the rotation restricting portion 44, which is a protrusion formed on the resin unit. However, the protrusion formed on the coupler may be engaged with the recess formed on the resin unit.

Figure 10A:
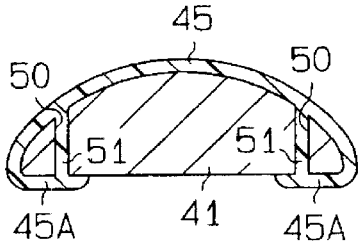
FIG. 10A is a partially enlarged cross-sectional view illustrating a coupler, a connecting portion, a pair of separation preventing pieces and a link portion in each through hole of the piston according to another embodiment of the present invention.

In the first preferred embodiment, as shown in FIG. 10A, a link portion 51 that is inserted in a through hole 50 may connect the connecting portion 45 at one side of the through hole 50 and the separation preventing piece 45A at the other side of the through hole 50 by forming the through hole 50 in the coupler 41. The connecting portion 45 and the link portion 51 are integrally formed to constitute a resin unit. Thereby, the connection between one side of the through hole 50 and the other side of the through hole 50 prevents the resin unit from separating from the coupler 41. Note that FIG. 10A is a cross-sectional view illustrating a portion corresponding to a cross-sectional portion in FIG. 3.

Figure 10B:
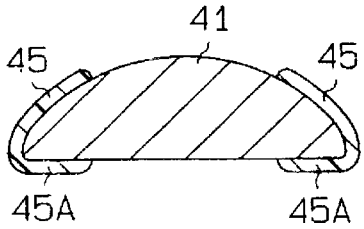
FIG. 10B is a partially enlarged cross-sectional view illustrating a coupler, a connecting portion and a pair of separation preventing pieces of the piston according to another embodiment of the present invention.
Figure 10C:
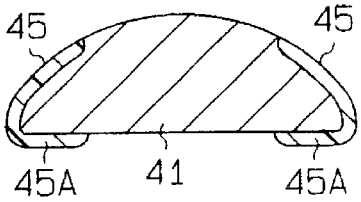
FIG. 10C is a partially enlarged cross-sectional view illustrating a coupler, a connecting portion and a pair of separation preventing pieces of the piston according to another embodiment of the present invention.
Figure 10D:
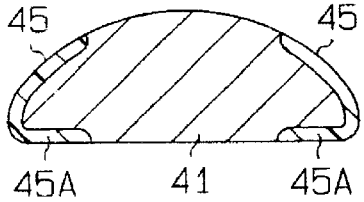
FIG. 10D is a partially enlarged cross-sectional view illustrating a coupler, a connecting portion and a pair of separation preventing pieces of the piston according to another embodiment of the present invention.

In the first preferred embodiment, as shown in FIG. 10B, the connecting portion 45 may be formed such that the coupler 41 is exposed at the middle of the connecting portion 45 in a circumferential direction of the piston body 40 (in a right-and-left direction in the drawing). In this case, as shown in FIGS. 10C and 10D, the strength of the coupler 41 may be improved by increasing the volume of the exposed portion of the coupler 41. As the coupler 41 shown in FIG. 10C is compared with the coupler 41 shown in FIG. 10B, the volume of the only portion at the opposite side to the drive shaft 16 is increased. As the coupler 41 shown in FIG. 10D is compared with the coupler 41 shown in FIG. 10C, the volume of the coupler 41 at the side of the drive shaft 16 is also increased. Note that FIGS. 10B through 10D are cross-sectional views illustrating portions corresponding to a cross-sectional portion in FIG. 3.

Figure 11:
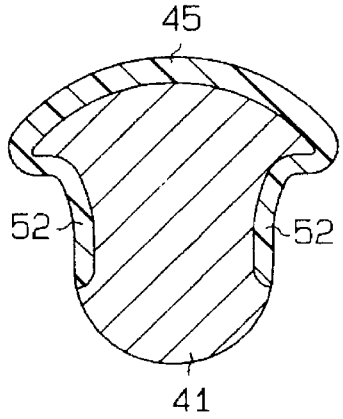
FIG. 11 is a partially enlarged cross-sectional view illustrating a coupler, a connecting portion and a pair of extending portions of the piston according to another embodiment of the present invention.

In the first preferred embodiment, as shown in FIG. 11, a pair of extending portions 52 may be formed on the right-and-left sides of the coupler 41 (on the right-and-left sides in FIG. 11) between the shoe inserted portion 42 of the coupler 41 and the piston body 40 so as to hold the coupler 41 with the connecting portion 45. The extending portions 52 are formed so as to cover the surfaces on the right-and-left sides of the coupler 41, thereby preventing the connecting portion 45 from separating from the coupler 41. Note that FIG. 11 is a cross-sectional view illustrating a portion corresponding to a portion of the piston taken along the line XI—XI in FIG. 4.

Figure 12A:
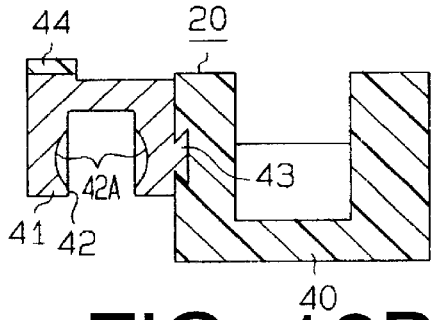
FIG. 12A is a cross-sectional view illustrating a piston according to another embodiment of the present invention.
Figure 12B:
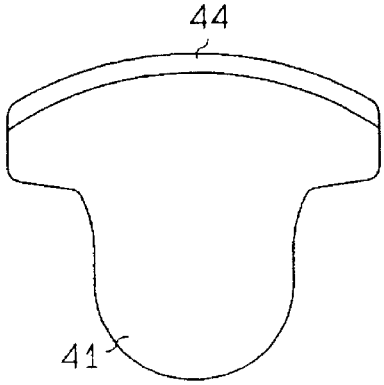
FIG. 12B is an enlarged end view illustrating a coupler and a rotation restricting portion of the piston in FIG. 12A.

In the above-described embodiments, the resin unit and the piston body 40 do not require forming integrally with each other. As shown in FIGS. 12A and 12B, the piston body 40 and the rotation restricting portion 44 may be separately formed by omitting the connecting portion 45 of the piston 20 in the first preferred embodiment and the separation preventing pieces 44A. In the constitution, as shown in FIG. 12B the widths in a vertical direction at the right-and-left ends at the front end of the coupler 41 are larger than those of the coupler 41 in the first preferred embodiment.

Figure 8:
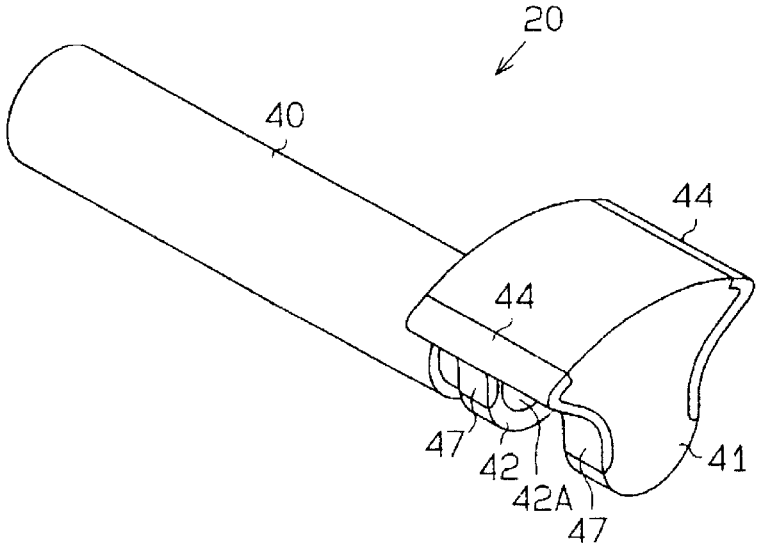
FIG. 8 is a perspective view of a piston according to another embodiment of the present invention.
Figure 9:
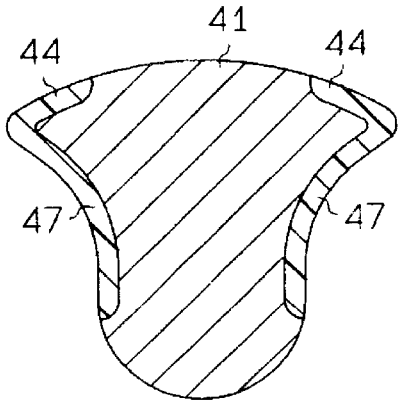
FIG. 9 is a partially enlarged cross-sectional view illustrating a coupler, a rotation restricting portion and a pair of extending portions of a piston according to another embodiment of the present invention.

In the second preferred embodiment, the rotation restricting portion 44 is not required forming so as to cover substantially the whole surface of the coupler 41 at the opposite side to the drive shaft 16. As shown in FIGS. 8 and 9, the rotation restricting portion 44 may be formed on the only portion that is capable of contacting the contact portion of the compressor housing. That is, the rotation restricting portion 44 may be formed on the only portion that covers both the ends in a circumferential direction of the piston body 40. Note that FIG. 9 is a cross-sectional view, which corresponds to FIG. 7, illustrating a portion of the only piston taken along the line VII—VII in FIG. 1.

A double-headed piston type compressor that performs a compression work in the cylinder bores formed at the front and rear sides so as to sandwich a crank chamber by the double-headed piston may be employed in place of the single-headed piston type compressor C that performs a compression work by the single-headed piston.

A wobble type compressor in which a cam plate wobbles by rotatably supporting the cam plate relative to the drive shaft 16 may be employed in place of the compressor C in which a cam plate such as the swash plate 18 integrally rotates with the drive shaft 16.

The compressor C may be a fixed displacement type of which stroke amount of the piston 20 is fixed.

In the above-described embodiments, the compressor C is employed as a fluid machine. An oil pump and an air pump may be employed in place of the compressor C.

The present examples and embodiments are to be considered as illustrative and not restrictive and the invention is not to be limited to the details given herein but may be modified within the scope of the appended claims.

What is claimed is:

1. A piston for a fluid machine, the fluid machine having a cylinder bore and a piston driving unit for driving the piston in a housing, the piston comprising:

a piston body made of resin accommodated in the cylinder bore;

a coupler made of metal connected to the piston body, the coupler being operatively connected to the piston driving unit; and a resin unit connected to the coupler for preventing the coupler from contacting a contacting portion on the side of the housing, the piston body and the resin unit being made of the same resin.

2. The piston according to claim 1, wherein the fluid machine has a cam plate that is driven due to a rotary motion of a drive shaft, the piston driving unit reciprocating the piston body along the cylinder bore through the cam plate operatively connected to the coupler, at least a part of the resin unit constituting a rotation restricting portion for restricting a rotation of the piston body and the coupler around an axis of the piston body by contacting the contacting portion.

3. The piston according to claim 2, wherein the cam plate is integrally rotatably supported by the drive shaft.

4. The piston according to claim 1, wherein the piston body and the resin unit are integrally formed.

5. The piston according to claim 1, wherein the resin unit which is formed so as to hold a part of the coupler prevents the coupler from separating from the resin unit.

6. The piston according to claim 1, wherein a recess is formed on one of the coupler and the resin unit while a protrusion is formed on the other of the coupler and the resin unit for engaging with the recess, the recess and the protrusion being engaged with each other.

7. The piston according to claim 1, wherein a through hole in which a part of the resin unit is inserted is formed in the coupler, the resin unit being connected to the part of the resin unit in the through hole substantially at one end and the other end of the through hole.

8. The piston according to claim 1, wherein an inserted portion which is substantially in the shape of a truncated cone is integrally formed with the coupler, and the inserted portion is formed such that the diameter of the proximal end is smaller than that of the distal end.

9. The piston according to claim 1, wherein the contacting portion is a bolt.

10. The piston according to claim 1, wherein the fluid machine is a variable displacement type compressor.

11. The piston according to claim 10, wherein the variable displacement type compressor is a swash plate type compressor.

12. The piston according to claim 1, wherein the piston body and the resin unit are made of fluoro resin or phenolic resin.

13. The piston according to claim 1, wherein the coupler is made of aluminum.

14. A method of manufacturing a piston for a fluid machine, the fluid machine having a cylinder bore and a piston driving unit for driving the piston in a housing, the piston having a piston body made of resin, a coupler made of metal and a resin unit, the piston body being accommodated in the cylinder bore, the coupler being connected to the piston body, the coupler being operatively connected to the piston driving unit, the resin unit being connected to the coupler for preventing the coupler from contacting a contacting portion of the housing, the method comprising the step of:

forming the resin unit and the piston body simultaneously in a process of forming the coupler by an insert molding.

15. The method of manufacturing a piston for a fluid machine according to claim 14 further comprising the steps of:

forming the couplers by forging or casting in a state that the two couplers are connected to each other;

inserting each end of the couplers into the respective piston bodies by the insert molding; and separating the two couplers individually after the outer circumferential surface of each piston body is machined.

* * * * *